United States Patent [19]

Althaus

[11] Patent Number: 5,063,669

[45] Date of Patent: Nov. 12, 1991

[54] RAZOR HEAD, ESPECIALLY RAZOR BLADE UNIT, OF A WET RAZOR

[75] Inventor: Wolfgang Althaus, Wuppertal, Fed. Rep. of Germany

[73] Assignee: Wilkinson Sword Gesellschaft mit beschränkter Haftung, Solingen, Fed. Rep. of Germany

[21] Appl. No.: 682,194

[22] Filed: Apr. 4, 1991

[30] Foreign Application Priority Data

Apr. 27, 1990 [DE] Fed. Rep. of Germany ... 9004762[U]

[51] Int. Cl.[5] ..... B26B 21/14

[52] U.S. Cl. ..... 30/77; 30/50

[58] Field of Search ..... 30/47-50, 30/77-78, 81, 32, 346.58

[56] References Cited

U.S. PATENT DOCUMENTS

| | | | |
|---|---|---|---|
| 3,872,592 | 3/1975 | Iten | 30/346.58 |
| 4,084,316 | 4/1978 | Francis | 30/47 |
| 4,389,773 | 6/1983 | Nissen et al. | 30/50 |

FOREIGN PATENT DOCUMENTS

| | | |
|---|---|---|
| 0306710 | 3/1989 | European Pat. Off. . |
| 3814135 | 11/1988 | Fed. Rep. of Germany . |

*Primary Examiner*—Douglas D. Watts

*Attorney, Agent, or Firm*—Robert W. Becker & Associates

[57] ABSTRACT

A razor head and especially a razor blade unit, is disposed at the front end of a handle of a wet razor and includes a plastic body that comprises a front guide strip and a rear cover. A single or double razor blade is disposed in the plastic body and rests upon a platform of a base member of the plastic body in such a way that it is fixed in position between this platform and an upper part of the plastic body that is secured to the base member. The front guide strip and the rear cover are interconnected via side parts while leaving a central opening in the vicinity of the cutting edge or edges of the razor blade or blades. The thus-formed, frame-like upper part is placed upon and connected to the base member.

8 Claims, 6 Drawing Sheets

RAZOR HEAD, ESPECIALLY RAZOR BLADE UNIT, OF A WET RAZOR

BACKGROUND OF THE INVENTION

The present invention relates to a razor head, and especially a razor blade unit, that is disposed at the front end of a handle of a wet razor. The razor head has a plastic body that comprises a forward guide strip and a rear cover, with a razor blade means in the form of a single or double razor blade being disposed in the plastic body. The razor blade means rests upon a platform or support means of a base member of the plastic body and is fixed in place between this support means and an upper part of the plastic body that is secured to the base member.

Various embodiments of wet or safety razors are known. In each case, disposed at the front end of a handle is a razor head that carries the single or double razor blade. The razor head can be integrally formed with the handle as a molded plastic part. If the razor head is separate from the handle and is to be secured thereto in an exchangeable manner via an appropriate mechanism, it is designated as a so-called razor blade unit, with a single or double razor blade being fixedly embedded in a plastic housing.

Various embodiments of razor heads in the form of such razor blade units are known. In each case, a plastic body is provided in which a single or double razor blade is fixedly embedded. This plastic body has a forward guide strip as well as a rear cover. The plastic body includes a base member that at the top defines a platform or support means upon which the single or double razor blade rests. The razor blade means is fixed between this base member and an upper part of the plastic body, with this upper part being the rear cover.

With such a known razor blade unit, the single or double razor blade is held securely in position between the base member of the plastic body and a rear cover. The forward guide strip is separate from the rear cover and is part of the base member of the plastic body. However, since the razor geometry is defined by the arrangement of the forward guide strip, the cutting edge or edges of the razor blade or blades, as well as the rear cover, and since with the heretofore known razor blade unit three individual components are involved that only after assembly form the razor blade unit, it is extremely difficult to achieve an optimum razor geometry due to the unavoidable deviations from the ideal positions of these three individual components.

It is therefore an object of the present invention to provide a razor head, and especially a razor blade unit, of a wet razor of the aforementioned general type whereby while affording a straightforward assembly, the reciprocal geometric coordination between the guide strip, the razor blade or blades, and the cover is improved.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
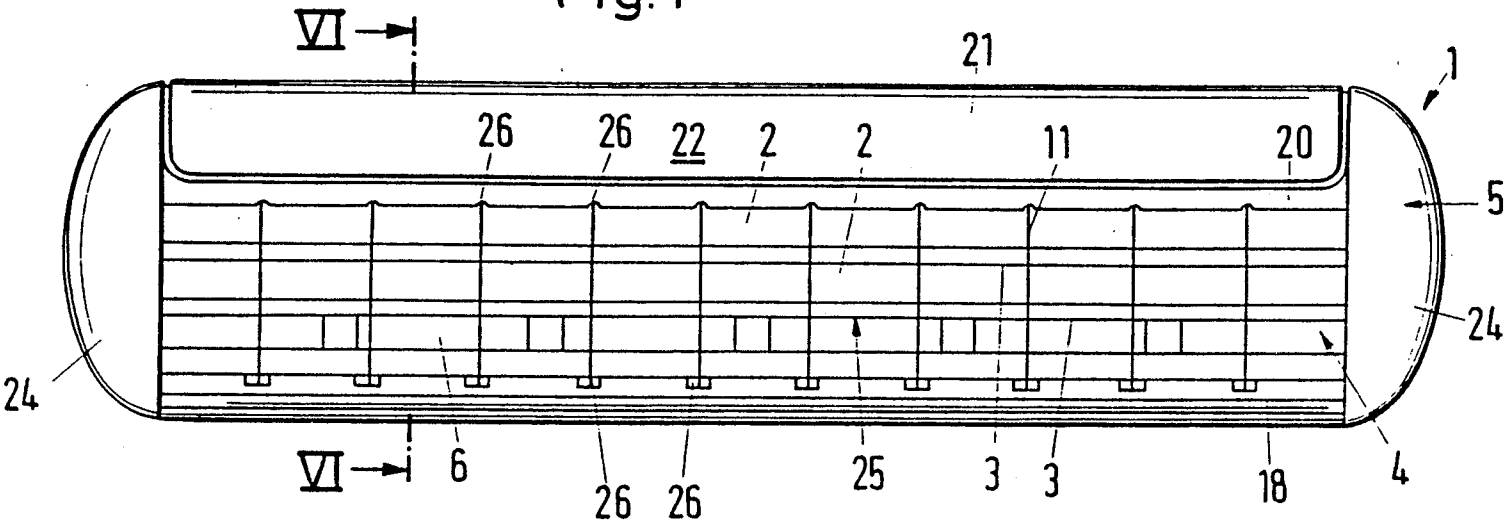
FIG. 1 is a top view of one exemplary embodiment of the inventive razor head in the form of a razor blade unit of a wet razor.
Figure 2:
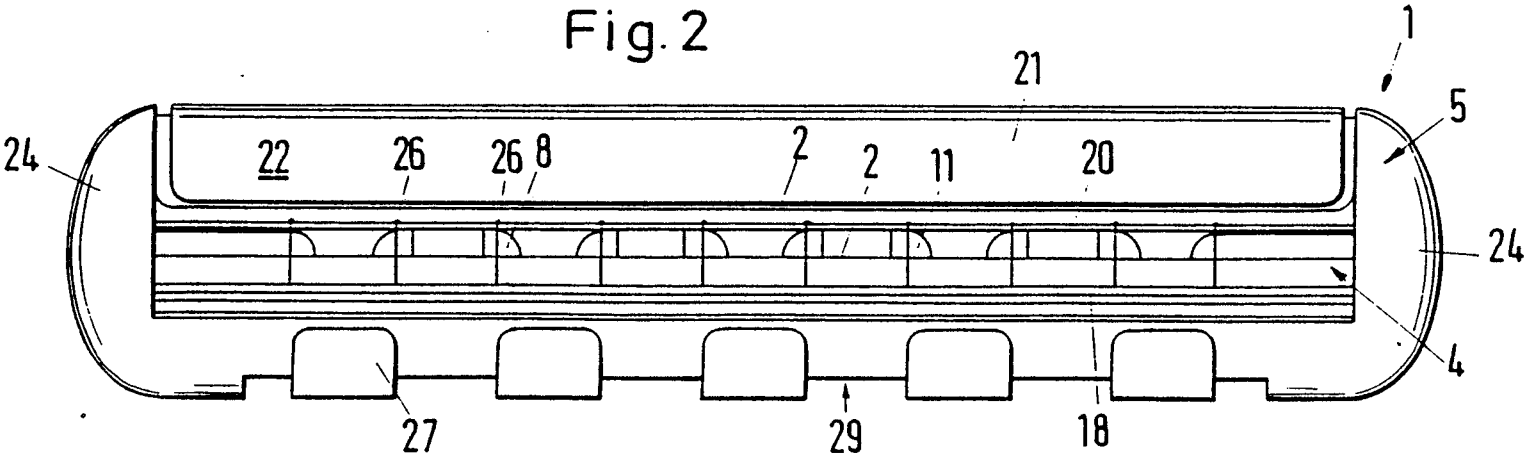
FIG. 2 is a front view of the razor blade unit of FIG. 1.
Figure 3:
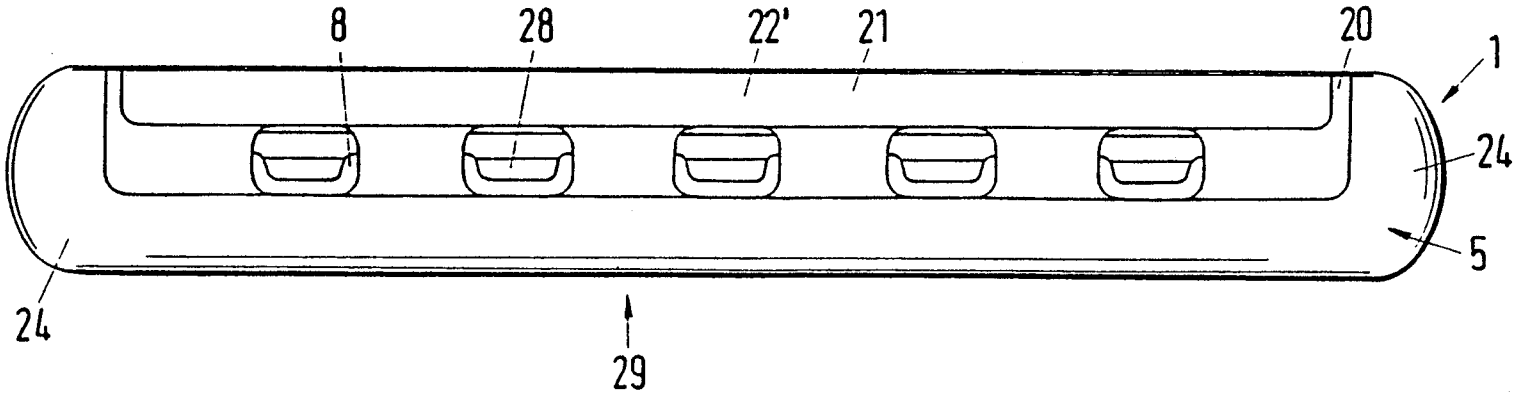
FIG. 3 is a rear view of the razor blade unit of FIG. 1.
Figure 4:
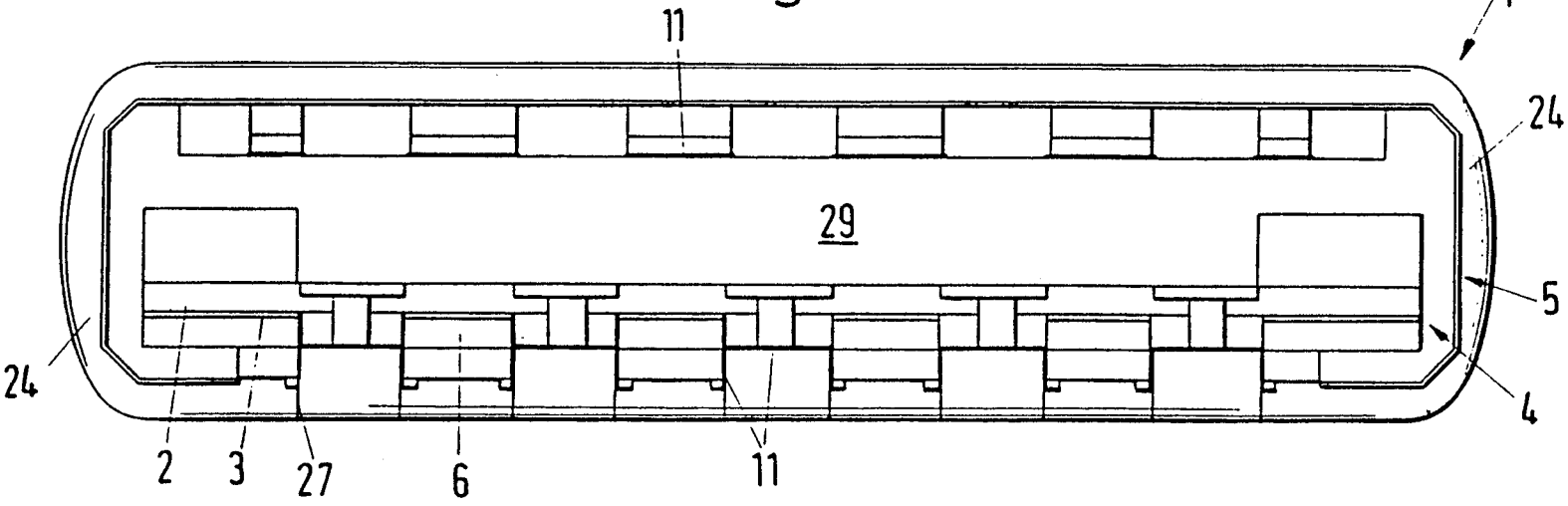
FIG. 4 is a bottom view of the razor blade unit of FIG. 1.
Figure 6:
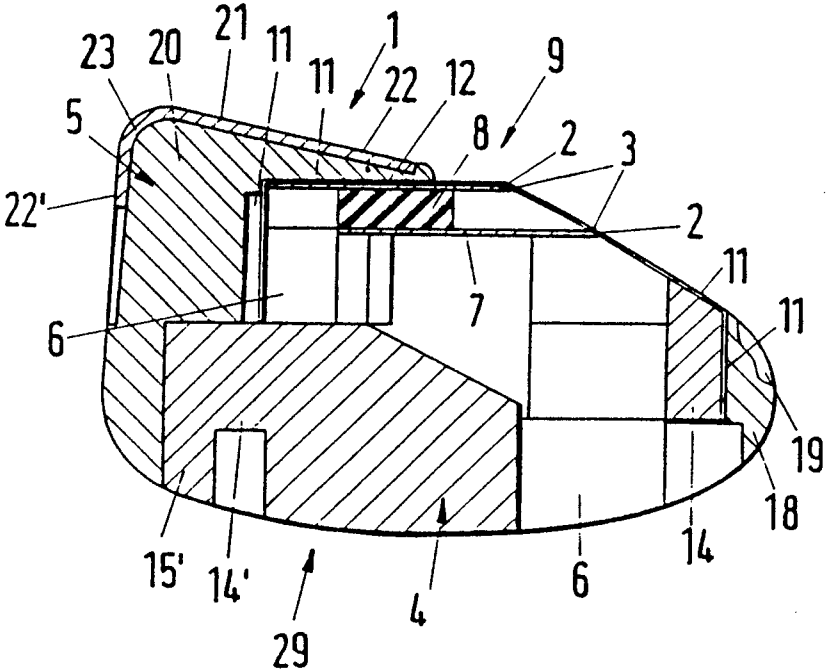
FIG. 6 is an enlarged cross-sectional view taken along the line VI—VI in FIG. 1.
Figure 5:
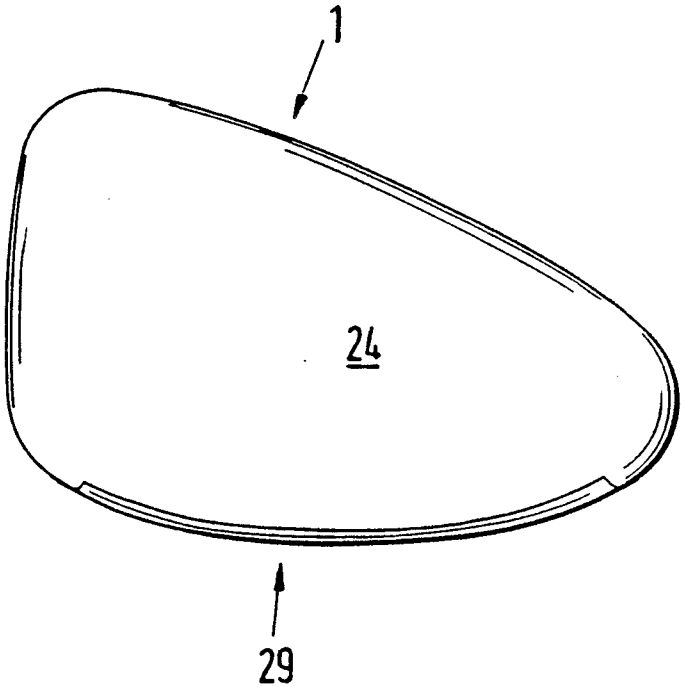
FIG. 5 is an enlarged side view of the razor blade unit of FIG. 1.
Figure 7:
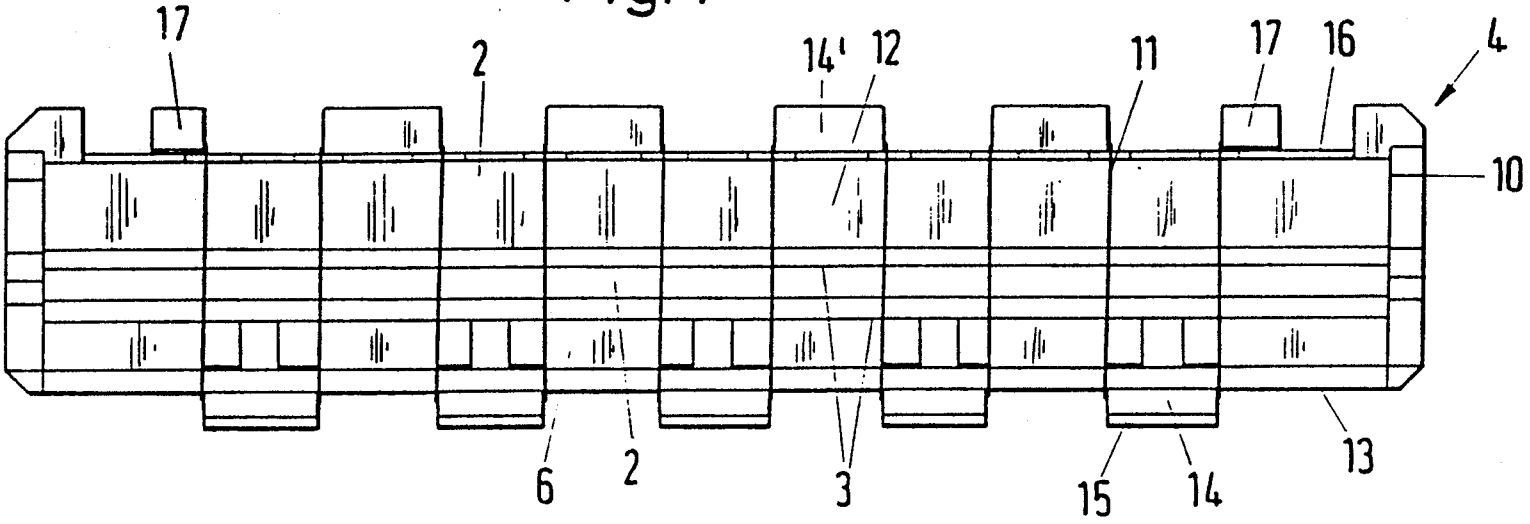
FIG. 7 is a top view of the base member of the razor blade unit without the upper part, which is formed by the forward guide strip, the rear cover, and the side walls.
Figure 8:
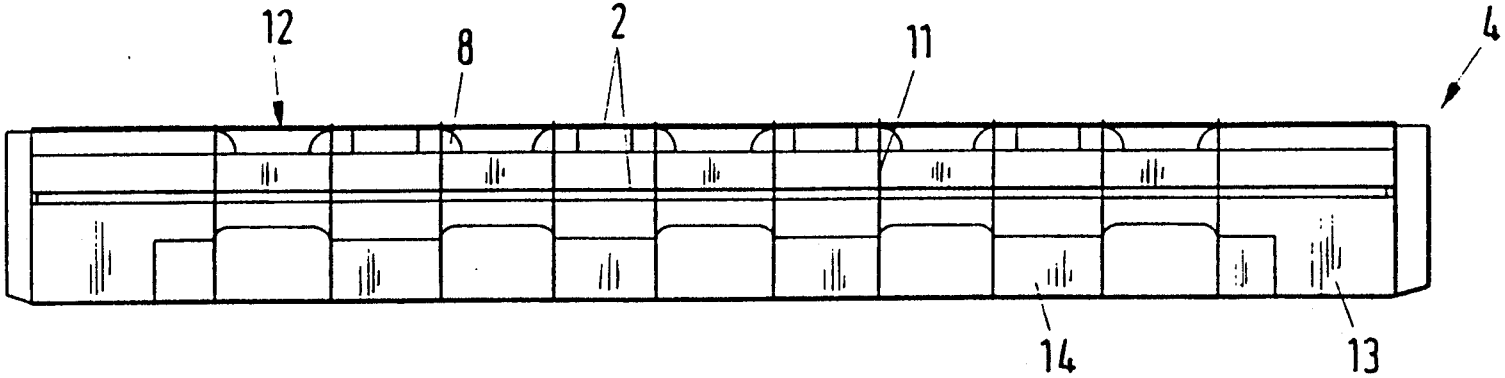
FIG. 8 is a front view of the base member.
Figure 9:
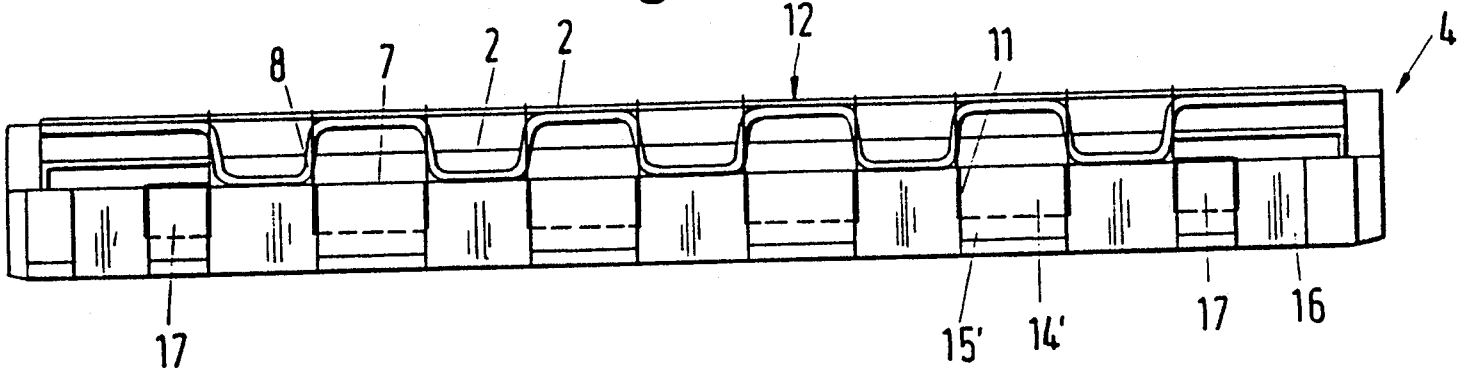
FIG. 9 is a rear view of the base member.
Figure 10:
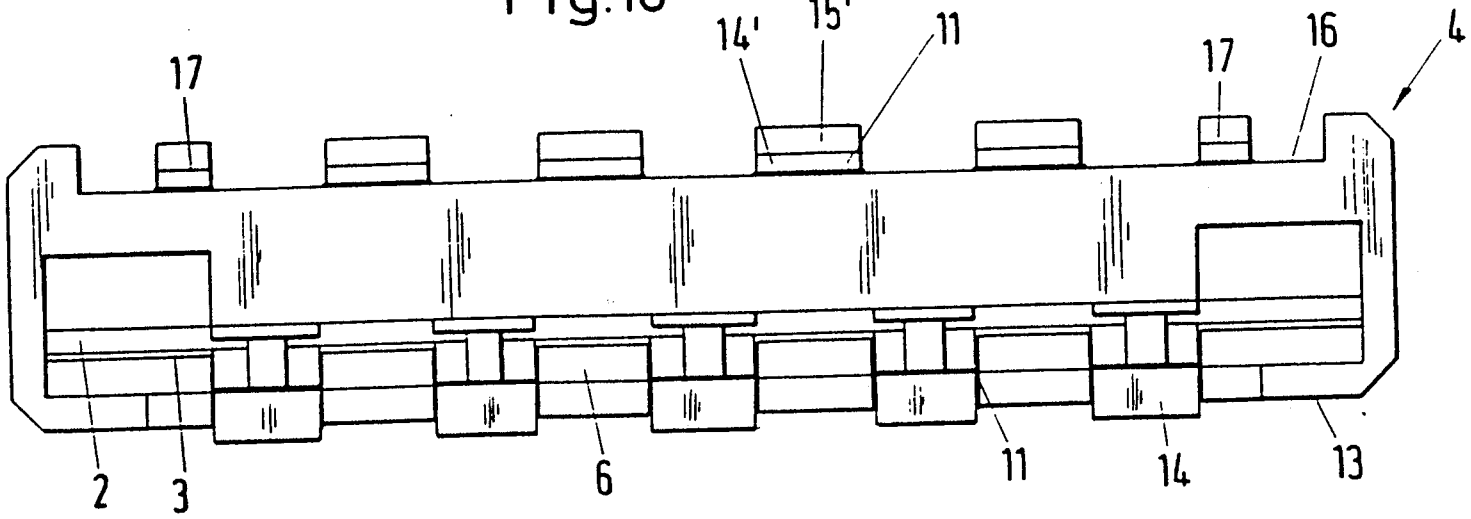
FIG. 10 is a bottom view of the base member.
Figure 11:
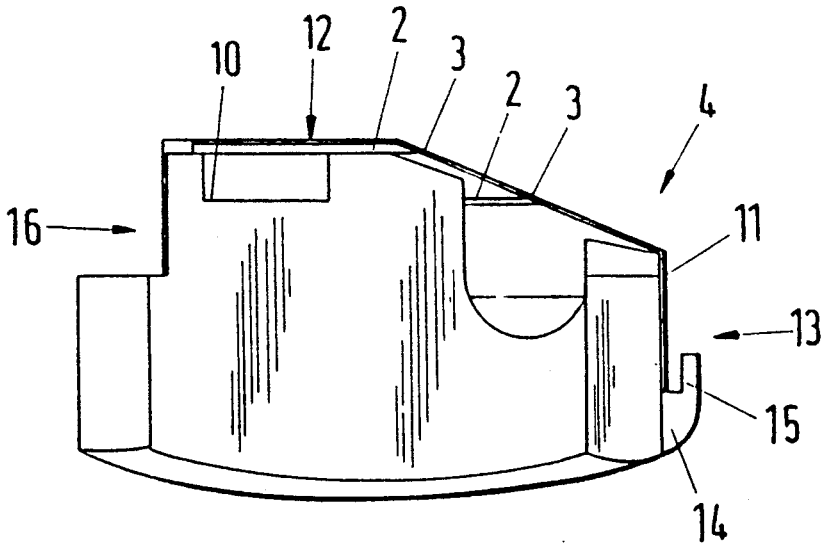
FIG. 11 is an enlarged side view of the base member.

The razor head of the present invention is characterized primarily in that the guide strip at the front side of the plastic body and the cover at the back side of the plastic body are interconnected via side strips while leaving a central opening in the vicinity of the cutting edges of the razor blade means, with the thusformed, frame-like upper part being placed upon and secured to the base member.

Thus, a straightforward assembly of the razor head, and in particular of the razor blade unit, is provided via this one-piece upper part, which is in the form of a molded plastic piece and is formed from the front guide strip, the rear cover, and the side strips. After the single or double razor blade is disposed upon the support means of the base member, it is merely necessary to place the upper part, essentially from above, onto the base member and to securely connect it thereto. This can be accomplished, for example, via interlocking or in any other suitable manner. Above all, the thus-constructed razor head has the advantage that the reciprocal geometric arrangement between the front guide strip on the one hand and the rear cover on the other hand is fixedly provided since these parts are formed by a one-piece component, so that reciprocal assembly deviations cannot occur. In order to provide the correct geometric arrangement for the third element that codetermines the razor geometry, namely the razor blade or blades, it is merely necessary to secure the frame-like upper part in an exact manner upon the base member. However, since the frame-like upper part has a relatively large surface and in particular also has mounting points in the region of the front guide strip, it is technically readily possible to undertake this process.

The side strips are preferably formed by side walls of the plastic body. This represents the simplest manner for connecting the front guide strip and the rear cover via a portion of the plastic housing.

Pursuant to a further specific embodiment of the present invention, it is proposed that the guide strip have a stepped longitudinal profiling.

Pursuant to a further specific embodiment of the inventive razor head, it is proposed that the single or double razor blade be held upon the support means of the base part by being wrapped with wire, with those inner sides of the guide strip and the cover of the frame-like upper part that face the wire being provided with receiving grooves for the wire. This wire, in the form of a protective wire, on the one hand has the advantage that it significantly improves the shaving characteristics. On the other hand, this wire has the advantage that after the single or double razor blade is placed upon the support means of the base member, the wire holds the razor blade means securely in place and thus provides a first securement or fixation. The placement and securement of the upper part upon the base member then serves merely for the final fixation of the single or double razor blade within the plastic body. It should be noted that the term "wire wrapping or winding" means that either a helical winding is provided or that the wire is merely guided in a zigzagged manner back and forth over the upper side of the razor head in the vicinity of the surface that engages the skin of a user, as will be described in detail subsequently.

If a double razor blade is provided, it is proposed pursuant to a further specific embodiment of the present invention that the two razor blades be secured to both sides of a spacer that is disposed between them, with the thus-formed razor blade/spacer/razor blade unit being inserted into the plastic body, essentially from above, onto the support means, where it is held by the wire. This provides an extremely simple preassembly of the double razor blade in that the appropriate unit is merely placed upon the base member and is held by the wire. It is then merely necessary to place the upper part upon the base member and to secure it thereto.

Pursuant to a further specific embodiment of the present invention, the cover is provided with a friction-reducing glide or anti-friction strip. This glide strip is preferably convexly curved, and pursuant to one preferred specific embodiment has a forward, essentially planar or slightly convexly curved leg as well as a rear, similarly essentially planar or slightly convexly curved leg that is disposed at an angle to the forward leg, with these two legs being interconnected via a rounded portion. Such a glide strip that is curved over the cover can be produced via a special hot molding process and can be applied. The particular advantage of such a configuration is that the glide strip is also more effective at the end of the razor head. Since the skin is made taut during shaving and is pressed in, a bulge is formed at the end of the razor head. The curved glide strip optimally glides in this region, and thus increases a comfortable shave.

Further specific features of the present invention will be described in detail subsequently.

DESCRIPTION OF PREFERRED EMBODIMENTS

Referring now to the drawings in detail, the illustrated razor head, which is in the form of a so-called razor blade unit for a wet or safety razor, and can be secured to the front end of a non-illustrated handle, comprises a plastic body 1 in which are disposed two razor blades 2, the cutting edges 3 of which extend parallel to one another and are offset one behind the other.

The plastic body 1 comprises a base member 4 that is provided with the razor blades 2, as well as an upper part 5 that is placed upon the base member 4.

The base member 4 of the plastic body 1 is provided with through slots 6 that are primarily disposed in the interior thereof. On the upper side, the base member 4 defines a platform or support means 7 for the razor blades 2. For this purpose, a spacer 8 is sandwiched between the two razor blades 2, which are securely connected to this spacer. These components thus form a razor blade/spacer/razor blade unit 9, which is placed from above upon the support means 7 of the base member 4. For this purpose, the spacer 8 projects out to the side and is received in recesses or slots 10 in the sides of the base member 4.

The unit 9 is held via a wire or other filament 11 that extends in a zigzagged or staggered manner; the wire 11 is guided over the upper side 12 of the unit 9, and hence of the base member 4 of the plastic body 1. To guide the wire 11, the lower portion of the front side 13 of the base member 4 is provided with downwardly directed, integral projections 14 that are embodied as elongated strips. The width of these projections 14 as viewed in the direction of the cutting edges 3 of the razor blades 2 essentially corresponds to the spacing between the projections 14. Toward the front, the projections 14 are provided with an upwardly extending extension 15.

In a similar manner, the back side 16 of the base member 4 is provided with projections 14' that are directed toward the rear. These projections 14' fill the gaps between the projections 14 of the front side 13. In a manner similar to the construction of the projections 14, the projections 14' are also provided with extensions 15', which, however, are directed downwardly. Finally, the back side 16 of the base member 4 is provided near its ends with respective integral mounting or securing projections 17.

One end of the wire 11 is first secured to one of the securing projections 17. Subsequently, the wire 11 is guided over the unit 9 toward the front and about a projection 14, whereupon it is turned by 180° to again extend toward the rear over the unit 9, where the wire 11 is guided about a pertaining projection 14'. The wire 11 is thus sequentially guided about the projections 14 and 14', whereupon the other end of the wire is finally secured to the securing projection 17 disposed at the other side of the base member 4. In this connection, portions of the wire 11 disposed in the region of the upper side 12 extend parallel to one another and essentially equidistantly from one another. The wire 11 serves a dual function of holding the unit 9 securely in place upon the support means 7 on the base member 4, and also preventing injury to the skin.

The upper part 5 is a one-piece plastic component and is provided with a forward guide strip 18 that extends parallel to the cutting edges 3 of the razor blades 2 and is provided with a stepped longitudinal profiling 19. A protective cover 20 is provided in the back region. This cover is provided at the top with a convexly curved glide or antifriction strip 21 having a first leg 22 and a second leg 22' that is disposed at an acute angle to the first leg 22 and is interconnected therewith via a rounded portion 23. The angle between the two legs 22, 22' of the glide strip 21 can also be 90° or an obtuse angle. The two legs 22, 22' of the glide strip 21 have an essentially planar or slightly convexly curved configuration. It is possible to produce such a glide strip 21 via a special hot mold process. The particular advantage of this glide strip 21 is that it is also more effective at the end of the razor blade unit. Since when shaving the skin is made taut and is pressed in, a bulge is formed at the end of the razor blade unit. Thus, the curved glide strip 21 glides better in this region and thus increases a comfortable shave.

The forward guide strip 18 and the rear cover 20 are interconnected by side walls 24. Disposed between these components is an opening 25 in the vicinity of the cutting edges 3 of the razor blades 2, as can be seen in particular in the top view of FIG. 1.

Both the inner side of the guide strip 18 as well as the inner side of the cover 20 are provided with receiving grooves 26 for the wire 11. Recesses 27 are provided below the guide strip 18 that interengage in a corresponding manner with the projections 14 of the base member 4. The back of the upper part 5, which is formed from the guide strip 18, the cover 20 and the side walls 24, is provided with through passages 28 that correspond with appropriate through passages in the spacer 8.

In the finish installed state, the upper part 5 is placed from above upon the base member 4, which includes the unit 9 that is secured by the wire 11. The upper part 5 is secured in place in, for example, an interlocking manner, or in any other convenient manner. The wire 11 extends in the receiving grooves 26 provided on the inner side of the upper part 5.

Extending the wire 11 in the vicinity of the upper side 12 has the advantage that the underside 29 of the plastic body 1 remains free, so that appropriate mounting or securing systems can be provided.

The present invention is, of course, in no way restricted to the specific disclosure of the specification and drawings, but also encompasses any modifications within the scope of the appended claims.

What I claim is:

1. A razor head, and especially a razor blade unit, disposed at the front end of a handle of a wet razor, comprising:

a plastic body that comprises a base member and an upper part, with said upper part being disposed on and secured to said base member and fixing a razor blade means in place between said base member and said upper part, whereby said base member has a support means for receiving said razor blade means, and said upper part is a frame-like member comprising a guide strip at a front side of said plastic body and a cover at a back side of said plastic body, with said guide strip and said cover being interconnected via side strips while leaving a central opening in the vicinity of cutting edges of said razor blade means.

2. A razor head according to claim 1, in which said side strips are formed by side walls of said plastic body.

3. A razor head according to claim 1, in which said guide strip is provided with a stepped longitudinal profiling.

4. A razor head according to claim 1, which includes a winding of wire for holding said razor blade means on said support means of said base member; and in which said guide strip and said cover of said frame-like upper part have inner sides that face said wire and are provided with grooves for receiving same.

5. A razor head according to claim 4, in which said razor blade means is a double razor blade connected to opposite sides of a spacer disposed therebetween to form a razor blade/spacer/razor blade unit that is disposed, essentially from above, onto said support means of said base member of said plastic body, with said wire holding said razor blade unit on said support means.

6. A razor head according to claim 1, in which said cover is provided with a glide strip.

7. A razor head according to claim 6, in which said glide strip is convexly curved.

8. A razor head according to claim 7, in which said glide strip has a forward, at most slightly convexly curved leg and a rear, at most slightly convexly curved leg, with said rear leg extending at an angle to said forward leg and being connected thereto via a rounded portion.

* * * * *